United States Patent [19]

Hall

[11] 4,421,603

[45] Dec. 20, 1983

[54] PROCESS FOR RECOVERING CARBONACEOUS LIQUIDS FROM SOLID CARBONACEOUS PARTICLES

[75] Inventor: Robert N. Hall, Boulder, Calif.

[73] Assignee: Tosco Corporation, Los Angeles, Calif.

[21] Appl. No.: 352,653

[22] Filed: Feb. 26, 1982

[51] Int. Cl.[3] ..... C10B 49/22; C10B 53/06; C10B 57/02

[52] U.S. Cl. ..... 201/12; 201/31; 201/38; 208/8 R; 208/11 R

[58] Field of Search ..... 201/12, 15, 16, 28–31, 201/38; 208/8 R, 11 R

[56] References Cited

U.S. PATENT DOCUMENTS

| | | | |
|---|---|---|---|
| 2,581,041 | 1/1952 | Ogorzaly et al. | 208/11 R |
| 2,618,589 | 11/1952 | Nicholson et al. | 201/4 |
| 2,623,815 | 12/1952 | Roetheli et al. | 201/31 |
| 2,643,219 | 6/1953 | Carr et al. | 201/31 |
| 2,690,990 | 10/1954 | Adams et al. | 201/12 |
| 2,955,077 | 10/1960 | Welinsky | 201/31 |
| 3,574,065 | 4/1971 | Eddinger et al. | 201/12 |
| 3,972,801 | 8/1976 | Gregoli | 208/11 R |
| 4,366,046 | 12/1982 | Bertelsen et al. | 201/31 |

FOREIGN PATENT DOCUMENTS 677140 8/1952 United Kingdom .

*Primary Examiner*—Bradley Garris

*Attorney, Agent, or Firm*—David J. Oldenkamp; Lyle J. Schlyer

[57] ABSTRACT

Pyrolysis process and system for recovering product gases and liquids from solid carbonaceous particles.

Dual stage fluidized bed retort is disclosed having frusto-conical stages serially connected to promote uniform pyrolysis. Product gases and oil are removed from final fluid bed stage in series. Process includes various energy efficient aspects involving recycle of dilute phase combusted solids as the heat carrier, heavy oil recycle and use of steam and/or product vapors as the source of fluidizing gas for the staged retort.

14 Claims, 1 Drawing Figure

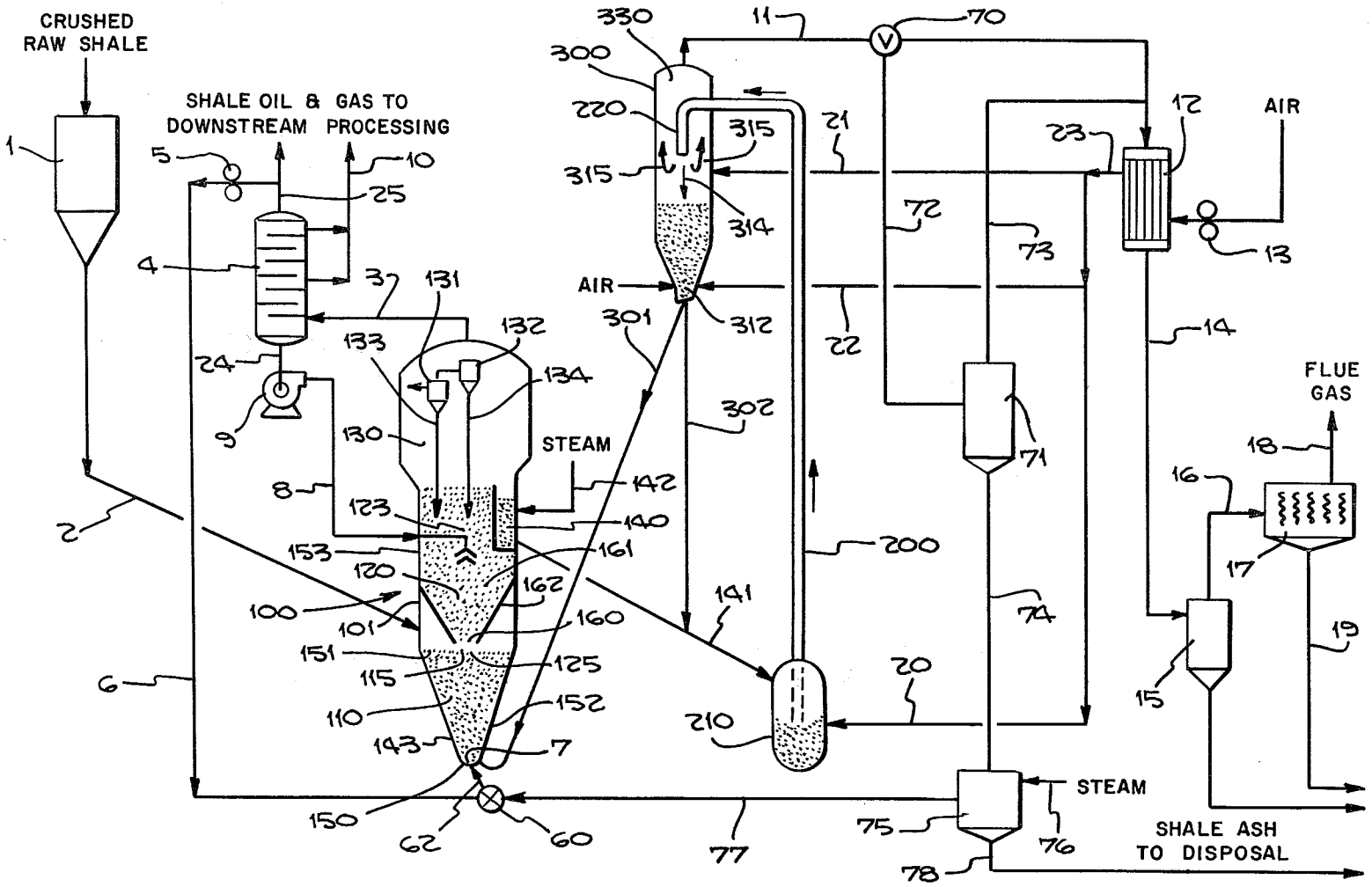
FLUE GAS
AIR
SHALE ASH TO DISPOSAL
STEAM
STEAM
AIR
SHALE OIL & GAS TO DOWNSTREAM PROCESSING
CRUSHED RAW SHALE

PROCESS FOR RECOVERING CARBONACEOUS LIQUIDS FROM SOLID CARBONACEOUS PARTICLES

BACKGROUND OF THE INVENTION

Liquid and gaseous hydrocarbons for energy use are in short supply throughout the world. Therefore, the prior art has attempted to produce liquid and gaseous carbonaceous material (e.g. hydrocarbons) from solid carbonaceous particles which also contains inorganic matter. In general, the prior art pyrolyzes the solid carbonaceous particles containing inorganic matter to produce carbonaceous liquids and gases which can then be used as energy sources.

One method suggested by the prior art is to pyrolyze the solid carbonaceous material in a fluidized bed in which the heat for the pyrolysis is supplied by heat-carrying bodies wherein the heat-carrying bodies are heated by combusting the residual carbon contained in the spent pyrolyzed solid carbonaceous particles. This method has some advantages over other pyrolysis methods in that fluid bed pyrolysis using heat-carrying bodies which have been reheated by combustion enables a more efficient use of the available energy in the solid carbonaceous particles. However, fluidized bed pyrolysis, as taught by the prior art, suffers certain disadvantages, one of the main ones being that the fluidization and pyrolysis are not uniform causing hot spots, etc. in the pyrolysis zone. In addition, in the prior art method utilizing a fluidized pyrolysis zone the spent carbonaceous particles are not efficiently combusted thereby wasting energy. This is particularly true when the solid carbonaceous particles contain mineral carbonates, such as dolomite and limestone, which decompose endothermically thereby causing a waste of heat.

Among prior art patents showing a fluid bed pyrolysis zone is U.S. Pat. No. 2,618,589. This patent discloses pyrolyzing solid carbonaceous particles in a fluidized bed using a two stage retort with a middle perforated screen between the two stages to prevent fines in the lower stage of the retort from entering the upper stage of the retort. Because of the rectangular shape of the pyrolysis stages (when viewed in sectional elevational view, as shown in FIGS. 1-3 of the patent), this patent suffers from a serious disadvantage in that fluidization and pyrolysis are not uniform. Moreover, although this patent does disclose a separate combustion zone for reheating the spent solid carbonaceous particles by burning the residual carbon in said spent carbonaceous particles, the combustion zone is not efficient and will cause the mineral carbonates in the spent carbonaceous particles to decompose endothermically.

From the foregoing it is readily apparent that it is a desideratum in the art to provide uniform pyrolysis and fluidization of solid carbonaceous material to recover carbonaceous liquids and gases therefrom and to do this economically and efficiently.

SUMMARY OF THE INVENTION

The primary object, therefore, of the present invention is to disclose and provide a process for pyrolyzing solid carbonaceous particles containing inorganic matter by uniformly fluidizing and pyrolyzing said solid carbonaceous particles.

Another object of the present invention is to provide a method wherein solid carbonaceous particles are converted to carbonaceous liquid and gases which may be utilized for energy purposes wherein the pyrolysis takes place in a fluidized bed in the presence of solid heat-carrying bodies, the spent pyrolyzed carbonaceous particles being combusted in a very efficient manner to provide the heat necessary to heat the heat-carrying bodies.

Another and further object of the present invention is to provide a novel pyrolysis zone having two frusto-conical stages in order to uniformly pyrolyze and fluidize solid carbonaceous particles.

Other objects of the present invention will be apparent from the following description.

The foregoing objects are in general accomplished in the present invention by utilizing a staged fluid bed pyrolysis zone for uniform pyrolysis in combination with an energy efficient method for supplying heat to the staged fluid bed pyrolysis zone involving the entrained dilute phase combustion of the carbon residue remaining on the spent pyrolyzed carbonaceous particles.

The pyrolysis zone of the present invention has at least two stages, a first pyrolysis stage and a second pyrolysis stage, the pyrolysis zone being located within a single pyrolysis retort. The first and second pyrolysis stages each have an inverted frusto-conical shape with an apex and a wider base, the two stages being vertically oriented such that the apex of the second pyrolysis stage is in fluid communication with the base of the first pyrolysis stage. This allows the pyrolysis vapors produced in the pyrolysis zone to flow in a divergent direction in each frusto-conical stage which is important in order to achieve uniform fluidization and pyrolyzation of the solid carbonaceous particles.

During pyrolysis, spent solid carbonaceous particles and carbonaceous pyrolysis vapors are formed. The spent solid carbonaceous particles contain inorganic material and a residual amount of carbon. A portion of the heat-carrying bodies and spent solid carbonaceous particles are transferred to a combustion zone where the residual carbon is combusted to heat the heat-carrying bodies.

This combustion zone, in the present invention, is a dilute phase entrained combustion zone to provide maximum energy utilization and, if operated with a sub-stoichiometric amount of oxygen, to provide minimum pollution production.

The present invention also provides a separator for separating the fines produced in the combustion zone from the other solids to prevent the fines from being reintroduced into the pyrolysis zone. This is very desirable since the fines adsorb a portion of the pyrolysis carbonaceous vapors resulting in a reduced yield of carbonaceous liquids and gases.

The present invention also may utilize a portion of the pyrolysis vapors produced in the pyrolysis zone to introduce the hot heat-carrying solids to the pyrolysis zone, said vapors having sufficient velocity to fluidize the heat-carrying bodies and solid carbonaceous particles in the pyrolysis zone.

As noted, the dilute phase entrained combustion zone may also be operated not only to provide maximum energy utilization but to provide a minimum production of pollutants such as $NO_x$. This is accomplished by maintaining the combustion of the spent solid carbonaceous particles in a sub-stoichiometric amount of oxygen.

Reference will now be made to the appended drawing.

DESCRIPTION OF THE DRAWING

FIG. 1 is a schematic flowsheet showing apparatus for carrying out the preferred process of the present invention.

DESCRIPTION OF THE PREFERRED EMBODIMENTS

Referring to FIG. 1 there is illustrated a pyrolysis retort, shown generally at 100. The pyrolysis retort 100 may be used for the pyrolysis of any of a number of solid carbonaceous material containing inorganic matter such as: oil shale, coal, lignite, tar sands, diatomaceous earth, etc. Prior to the introduction of such solid carbonaceous material containing inorganic matter to the pyrolysis system, it is preferably crushed or ground in any conventional manner so that there is formed solid carbonaceous particles containing inorganic matter, the size of the particles ranging from 2 inches to about 20 mesh (Tyler) with the preferred range being less than about an eighth of an inch or 6 mesh (Tyler). It should be noted that such solid carbonaceous particles may contain mineral carbonates such as dolomite and limestone. For example, oil shale typically contains such mineral carbonates and in the preferred exemplary embodiment reference will be made to such oil shale particles, it being understood that this is for illustrative purposes only and that other types of solid carbonaceous particles may be utilized to obtain carbonaceous gases and liquids.

As can be seen from the drawing, the pyrolysis retort 100 is composed of two major zones, a pyrolysis zone 101 comprising a first pyrolysis stage 110 and a second pyrolysis stage 120 and the disengaging zone 130.

The pyrolysis zone itself may have two or more stages but, as noted above, in the preferred exemplary embodiment the pyrolysis zone comprises two pyrolysis stages, a first pyrolysis stage 110 and a second pyrolysis stage 120. Both the first and second pyrolysis stages are of an inverted frusto-conical configuration which is important in the present invention because this provides for uniform fluidization and pyrolyzation (i.e. the pyrolysis rate is uniform). This provides many advantages. One of the most important is that the carbonaceous pyrolysis vapors are released uniformly and thereby provide a substantial amount of the non-combusting fluidizing gas necessary for uniform fluidization. This minimizes the requirement for an outside source of fluidizing gas such as steam or recycle gas. Moreover, this allows one to pyrolyze large quantities of solid carbonaceous particles in a single pyrolysis retort.

Both the first and second pyrolysis stages have an apex at 150 and 160, a base at 151 and 161 and a conical side, at 152 and 162.

The two stages are vertically oriented relative to each other such that the base 151 of the first pyrolysis stage 110 is connected to and in fluid communication with the apex 160, of the second pyrolysis stage, the products of pyrolysis (i.e. carbonaceous pyrolysis vapors and partially pyrolyzed solid carbonaceous particles) and heat carrying bodies pass from the first pyrolysis stage 110 to the second pyrolysis stage 120 through inlet 115.

In the preferred exemplary embodiment the second pyrolysis stage also has an upper cylindrical portion shown generally at 153 which is integral with the frusto-conical portion. The cylindrical portion 153 of the second pyrolysis stage 120 increases the residence time of the solid carbonaceous particles in order to obtain essentially complete pyrolysis.

Raw oil shale particles are introduced into the first pyrolysis stage from a raw shale surge bin 1 by way of feed line 2. The oil shale particles should have a particle size of between 2 inches and 20 Tyler mesh but preferably particle size is less than about 0.5 inches and preferably less than about 6 Tyler mesh. It is preferable if the raw oil shale particles are preheated to at least about 220° F. (but below the pyrolysis temperature) prior to their introduction into the pyrolysis zone. Hot heat-carrying solids, which will be discussed in detail later, are introduced into the first pyrolysis stage 110 through line 301 at 7, the temperature and amount of heat-carrying bodies introduced into said first pyrolysis stage being sufficient to raise the solid raw oil shale particles to their pyrolysis temperature. In the preferred exemplary embodiment the heat-carrying bodies will have a temperature of between about 1200° F. to 1400° F. and the pyrolysis temperature in both the first pyrolysis stage and the second pyrolysis stage will range between about 900° F. and 1100° F.

The hot heat-carrying bodies, which are introduced into the first pyrolysis stage at 7 are transported by a non-combusting fluidizing gas which is mixed with the hot heat-carrying bodies in line 301 at 7 or in the first pyrolysis stage 110. The non-combusting gas has sufficient velocity to fluidize the oil shale particles and hot heat-carrying bodies. This gas may be any type of non-combusting gas such as steam as will be discussed later or alternatively the non-combustion fluidizing gas is a portion of the pyrolysis vapors formed in the pyrolysis zone by the pyrolysis of the oil shale particles which are recycled to the retort as the fluidizing gas. This gas, as noted, may be introduced to the first pyrolysis stage at 7 via pyrolysis gas line 6, valve 60 and line 62. The remainder of the non-combusting fluidizing gas in the pyrolysis retort is the carbonaceous pyrolysis vapors formed in situ. In such manner the pyrolysis vapors formed in the pyrolysis zone may advantageously be employed to form at least part of the non-combusting fluidizing gas.

The initial fluidizing of the raw oil shale particles, hot heat-carrying bodies in the non-combustion fluidizing gas occurs in the first pyrolysis stage 110 where the raw oil shale and hot heat-carrying solids are fluidized by such gas. Partial pyrolysis of the oil shale particles occurs as the fluidized mixture moves upwards through the first pyrolysis stage 110 into the second pyrolysis stage 120, said pyrolysis and fluidizing being uniform throughout both the first and second pyrolysis stages.

The second pyrolysis stage 120, as has been noted, is inverted frusto-conical in shape with dimensions similar to the first stage 110. The second pyrolysis stage 120 has an inlet 115 at the apex 160 which is in communication with the base 151 of the first pyrolysis stage 110. In the second pyrolysis stage 120 the pyrolysis of the oil shale particles is, if desired, completed or, alternatively, one or more other stages (not shown) may be used to complete pyrolysis. In the preferred exemplary embodiment the pyrolysis is completed in the cylindrical portion 153 of the second pyrolysis stage 120.

In general, the average residence time of the oil shale particles in the pyrolysis zone 101 will be between about 2 to 15 minutes with 5 to 10 minutes being the most desirable.

During the pyrolysis of the oil shale particles in the pyrolysis zone, there is formed carbonaceous pyrolysis vapors and spent solid carbonaceous particles (i.e. spent oil shale) which will contain inorganic matter and residual fixed carbon. In addition, the spent oil shale particles will contain mineral carbonates (e.g. dolomite) and both the spent oil shale particles and the hot heat-carrying bodies will have adsorbed on their surface a certain residual amount of carbonaceous liquid which may be steam stripped in a manner discussed later.

The carbonaceous pyrolysis vapors, containing entrained spent shale and heat-carrying bodies, flow upward through a disengaging zone 130 where the pyrolysis carbonaceous vapors are separated from the heat-carrying solids and spent shale by cyclone separators 131 and 132. The solid materials are then passed from the separators back to the fluid bed in the second pyrolysis stage as shown by arrows 133 and 134. The carbonaceous pyrolysis vapors resulting from the pyrolysis of the raw oil shale particles now contain substantially reduced solid material and are transferred via vapor removal line 3 to a conventional fractionating tower 4.

The carbonaceous pyrolysis vapors include both uncondensed or entrained carbonaceous pyrolysis liquids and carbonaceous pyrolysis gases. The liquids include heavy oil resid containing bottoms sediment and oil. The gases include naphtha. In fractionating tower 4 the heavy oil resid is condensed at the bottom and pumped by heavy oil pump 9 through line 8 to the second pyrolysis stage 120 where the oil is further pyrolyzed. Alternatively, the heavy oil resid may be recycled to the first pyrolysis stage 110 if more complete cracking thereof is desired. The remaining pyrolysis vapors flow upwards through tower 4 where the condensed oil is removed via line 10 and the uncondensed gases are removed at the top of tower 4 via line 25.

In the preferred exemplary embodiment, a portion of the gas leaving the fractionating tower 4 through line 25 is compressed by recycle gas compressor 5 and transferred through conduit 6, valve 60 and line 62 for reintroduction at 7 into the first pyrolysis stage 110 as the non-combusting fluidizing gas. The carbonaceous pyrolysis gas is reintroduced to the first pyrolysis stage 110 at 7 so that said gas conveys the recycled heat-carrying bodies to the first pyrolysis stage, the gas having sufficient velocity to fluidize the material in the first and second pyrolysis stages.

This particular recycle loop is only one of a number of energy efficient concepts utilized in the preferred embodiment of the present invention. Other areas of heat efficient operation in the present invention are provided for in the processes involving the heat-carrying solids, which as previously mentioned are introduced into the first stage pyrolysis zone 110 for heating the raw oil shale to pyrolysis temperatures. The following discussion relates to the processing of the heat-carrying solids.

The hot heat-carrying bodies may be an attrition resistant material, for example, vitreous silica. The hot heat-carrying solids will have a particle size greater than the particle size of the fines produced by combusting the spent solid carbonaceous particles produced in the pyrolysis zone, said fines having a particle size in general of less than about 200 Tyler mesh and therefore the heat-carrying bodies should have a particle size greater than about 200 Tyler mesh. If the heat-carrying bodies are solely made up of material not produced in situ, i.e., an externally supplied heat carrier, then preferably the heat-carrying bodies will have a particle size greater than the particle size of the raw oil shale particles introduced into the pyrolysis zone. However, most carbonaceous material, including oil shale, contains attrition resistant material which may be used, in whole or in part, as the heat-carrying bodies. In the preferred exemplary embodiment of the present invention, at least a portion (e.g, from 10 weight % to 100 weight %) of the heat-carrying bodies are supplied by the attrition resistant material in the original carbonaceous material, said attrition resistant material having a particle size of greater than 200 mesh after combustion, the carbonaceous ash having a particle size less than about 200 mesh being separated from the remaining solid particles in the combustion zone (which will be discussed in greater detail infra) and disposed of.

The hot heat-carrying bodies and the spent solid pyrolyzed shale particles are removed from the second pyrolysis stage 120 and transferred into steam stripping zone 140 where any residual hydrocarbon pyrolysis products are stripped from the heat-carrying bodies and spent pyrolysis shale particles by stripping steam 142.

The spent shale and heat-carrying bodies are now in a cooled condition after the steam stripping and the spent shale still contains a residual amount of fixed carbon which, in the present invention, is utilized to supply heat for the pyrolysis zone. The cooled heat-carrying bodies and spent shale pass out of the pyrolysis retort 100 by gravity flow through line 141 to the lift pot 210. Prior to reaching the lift pot 210, hot heat-carrying solids are added to the cool heat-carrying solids and spent shale in line 141 by way of recycled conduit 302. This raises the temperature of the cooled heat-carrying solids and spent shale to between 1000° F. and 1100° F. At this temperature, rapid ignition of the residual fixed carbon on the spent shale is assured.

An oxygen containing gas, such as air, is transferred to the lift pot via lift gas conduit 20. The oxygen containing gas with entrained heat-carrying solids and spent shale particles flow up the entrained dilute phase combustion zone 200. The oxygen containing gas, which has been preheated in ash-air exchanger 12, is introduced at a sufficient rate to insure a residence time for the heat-carrying solids in spent shale in the entrained dilute phase combustion zone 200 of only a few seconds. In the preferred exemplary embodiment the oxygen containing gas contains a sub-stoichiometric amount of oxygen, based on the amount of fixed carbon present, so that the amount of oxygen is insufficient to combust all of the fixed carbon on the spent shale thereby producing mainly carbon monoxide during the combustion process and, more importantly, reducing the amount of $NO_x$ in the combustion flue gas to less than about 100 parts per million thereby rendering the combustion flue gas substantially non-polluting.

The fixed carbon on the spent shale is rapidly combusted in the entrained dilute phase combustion zone to minimize decomposition of the carbonates contained in the spent shale and thereby to minimize heat loss since the decomposition of the carbonates is an endothermic reaction. By using the dilute phase entrained combustion method the retention time of the spent shale as well as the shale ash fines produced by combusting the spent shale is held to a minimum since the preheating of the heat-carrying bodies and spent shale and the dilute phase entrained combustion method has been found to be very efficient.

The amount of hot heat-carrying bodies introduced through recycle conduit 302 and the amount of oxygen in the oxygen containing gas are such that the heat-carrying bodies are reheated to a sufficient temperature to raise the raw oil shale particles to their pyrolysis temperature when the heat-carrying bodies are recycled to the retort. In the preferred exemplary embodiment the temperature at the top of the entrained dilute phase combustion zone 200 is between about 1200° F. and 1400° F.

During combustion of the fixed carbon in the entrained dilute phase combustion zone 200 there is formed shale ash having a particle size less than about 200 mesh and attrition resistant inorganic combusted particles. In the preferred exemplary embodiments a portion of the heat-carrying solids are the attrition resistant inorganic particles formed during the combustion of the spent carbonaceous particles.

The heat-carrying solids, including the attrition resistant inorganic particles, the ash and the combustion flue gas are propelled out of the entrained dilute phase combustion zone via downspout 220 into ash separator 300. The heat-carrying solids, including attrition resistance inorganic particles are separated from the ash in ash separator 300 because the heat-carrying solids, due to their larger size and weight, continue downward through the ash separator 300 as indicator by arrow 314. The flue gas with ash fines flow upward in the ash separator 300 to gas zone 330 as shown by arrows 315.

Any remaining ash mixed with the heat-carrying bodies is separated by introducing elutriating air via line 22 into the bottom of the ash separator 300 thereby lifting the remaining ash into gas zone 330. In the preferred exemplary embodiment the elutriation air is preheated by the heat exchanger 12 to a temperature of 1100° F. to 1300° F. and, as noted, introduced at a sufficient rate to uplift the ash which has a particle size of less than about 200 Tyler mesh.

Since it is preferred that the amount of oxygen in the entrained dilute phase combustion zone is sub-stoichiometric, secondary air is provided to the ash separator 300 through the secondary air conduit 21. This secondary air contains sufficient oxygen to combust the carbon monoxide contained in the combustion flue gas. This secondary combustion of the carbon monoxide provides extra heat but does not appreciably increase the amount of $NO_X$. The hot air which is used for the secondary air, air for elutriation and oxygen containing gas for the combustion zone 200 is supplied from the combustion air compressor 13 which compresses air heated in the ash/air heat exchanger 12. Heat is supplied to the ash/air heat exchanger 12 from line 11 which transports the hot flue gas including entrained ash from the ash separator 300 to the ash/air heat exchanger 12. The ash/air heat exchanger 12 cools the flue gas and ash from the ash separator 300 while heating air which is compressed by the combustion air compressor 13 and travels from the ash/air heat exchanger 12 through line 23 to secondary air line 21, elutriation air line 22 and lift pipe gas line 20.

The cooled flue gas and entrained ash from the ash/air heat exchanger 12 travel through conduit 14 to an ash cyclone 15 where the ash is removed for disposal with the flue gas being transferred via line 16 to an electrostatic precipitator 17 where further cleanup is accomplished with flue gas being removed via line 18 and any remaining ash is removed from the electrostatic precipitator 17 through line 19.

The heat-carrying bodies which remain in the ash reservoir are transferred via line 301 back to the pyrolysis retort 100 at 7. Additionally, the hot heat-carrying bodies are recycled through conduit 302 by gravity to supply any additional heat which may be necessary to supplement the preheating of the cooled heat-carrying bodies.

As previously mentioned, steam may also be used as a non-combustible fluidizing gas in the retort 100. A preferred source of steam as a fluidizing gas is provided as follows. A valve 70 is provided in line 11 for diverting, if desired, a portion of the hot ash fines containing flue gas to a cyclone separator 71 by way of line 72. In cyclone separator 71, the shale ash fines are separated from the flue gas. The flue gas is passed through line 73 back to line 11 for processing through the heat exchanger 12, and electrostatic precipitator 17.

The shale ash solids separated out in cyclone 71 are passed through line 74 to a solids heat exchanger 75. In the solids heat exchanger, steam which is introduced through line 76 is heated and the shale ash fines cooled. The heated steam is passed through line 77 to valve 60 where it is introduced into line 62 to provide fluidization gas. Valve 60 may be opened and closed as desired to provide varying amounts of steam to the retort through line 62. The steam from line 77 may be used to supplement fluidizing vapors being recycled through line 6. When desired, steam from line 77 may be utilized as the sole fluidizing gas. The relatively cool shale ash fines produced during the heat exchange with steam in heat exchanger 75 are removed through line 78 and transferred to suitable disposal equipment.

Having thus described the preferred exemplary embodiment of the present invention, it should be understood by those skilled in the art that various alternatives and modifications thereof may be made within the scope and spirit of the present invention which is defined by the following claims.

I claim:

1. A method for pyrolyzing carbonaceous materials which comprises pyrolyzing solid carbonaceous particles in a pyrolysis zone having a first pyrolysis stage and a second pyrolysis stage, said pyrolysis zone being located within a single pyrolysis retort, both of said pyrolysis stages having an inverted frusto-conical shape with an apex and an open base, said pyrolysis stages being vertically oriented within said pyrolysis retort so that said second pyrolysis stage is located above said first pyrolysis stage, the apex of the second pyrolysis stage having an inlet in fluid communication with the base of said first pyrolysis stage, said pyrolysis comprising (i) forming, in said pyrolysis zone, a fluidized mixture of said solid carbonaceous particles and attrition resistant solid heat-carrying bodies in a fluidizing non-combusting gas having sufficient velocity to form said fluidized mixture of solid carbonaceous particles and solid heat-carrying bodies, the amount and temperature of said heat-carrying bodies being sufficient to heat said solid carbonaceous particles to their pyrolysis temperature; and (ii) uniformly pyrolyzing said fluidized solid carbonaceous particles within said pyrolysis zone by flowing said fluidized mixture upward through said first pyrolysis stage, through said inlet and upward through said second pyrolysis stage to form carbonaceous pyrolysis vapors and spent pyrolyzed solid carbonaceous particles containing inorganic material and residual carbon, separating said vapors from said spent solid particles and removing said vapors and said spent solid particles from said pyrolysis zone.

2. A method according to claim 1 wherein said fluidizing non-combusting gas is steam.

3. A method according to claim 1 wherein said fluidizing non-combusting gas includes vapors removed from said pyrolysis zone which have been recycled to said first pyrolysis stage.

4. A method according to claim 1 wherein said pyrolysis vapors are condensed to form various product oils including heavy oil resid, said method including recycle of said heavy oil resid to said pyrolysis zone.

5. A continuous method for efficiently and economically recovering carbonaceous liquids and gases from solid carbonaceous particles containing inorganic material which comprises:

(a) pyrolyzing said solid carbonaceous particles in a pyrolysis zone having a first pyrolysis stage and a second pyrolysis stage, said pyrolysis zone being located within a single pyrolysis retort, both of said pyrolysis stages having an inverted frusto-conical shape with an apex and an open base, said pyrolysis stages being vertically oriented within said pyrolysis retort so that said second pyrolysis stage is located above said first pyrolysis stage, the apex of the second pyrolysis stage having an inlet in fluid communication with the base of said first pyrolysis stage, said pyrolysis comprising (i) forming, in pyrolysis zone, a fluidized mixture of said solid, carbonaceous particles and attrition resistant solid heat-carrying bodies in a fluidizing non-combusting gas having sufficient velocity to form said fluidized mixture of solid carbonaceous particles and solid heat-carrying bodies, the amount and temperature of said heat-carrying bodies being sufficient to heat said solid carbonaceous particles to their pyrolysis temperature; and (ii) uniformly pyrolyzing said fluidized solid carbonaceous particles within said pyrolysis zone by flowing said fluidized mixture upward through said first pyrolysis stage, through said inlet and upward through said second pyrolysis stage to form carbonaceous pyrolysis vapors and spent pyrolyzed solid carbonaceous particles containing inorganic material and residual carbon, said pyrolysis vapors being substantially uniformly distributed throughout said first pyrolysis stage and said second pyrolysis stage, said fluidizing non-combusting gas being predominantly composed of said carbonaceous pyrolysis vapors;

(b) conveying said carbonaceous pyrolysis vapors containing entrained solid heat-carrying bodies and spent carbonaceous particles to a disengaging zone and separating said solid heat-carrying bodies and spent pyrolyzed solid carbonaceous particles from said carbonaceous pyrolysis vapors;

(c) conveying the now cooled heat-carrying bodies and spent pyrolyzed solid carbonaceous particles containing a residual amount of carbon to an entrained dilute phase combustion zone;

(d) rapidly reheating the heat-carrying bodies and spent carbonaceous particles in said entrained dilute phase combustion zone to a temperature sufficient to pyrolyze said solid carbonaceous pyrticles by combusting the carbon in said spent carbonaceous particles with oxygen to form a combustion flue gas containing entrained hot heat-carrying bodies and inorganic combusted particles; and (e) introducing said hot heat-carrying bodies at the bottom portion of said first pyrolysis stage and introducing fluidizing non-combusting gas at substantially the same location in said first pyrolysis stage as said heat-carrying bodies are introduced, said fluidizing non-combusting gas having sufficient velocity to fluidize said solid carbonaceous particles and said heat-carrying bodies in said pyrolysis zone.

6. A method according to claim 5 wherein said spent pyrolyzed carbonaceous particles contain mineral carbonates, the mineral carbonates being substantially non-decomposed in the entrained dilute phase combustion zone.

7. A method according to claim 6 wherein the cooled heat-carrying bodies and spent pyrolyzed carbonaceous particles are preheated, prior to introduction into the entrained dilute phase combustion zone, by contacting said cooled heat-carrying bodies and spent pyrolyzed carbonaceous particles with a portion of the hot heat-carrying bodies preheated in said entrained dilute phase combustion zone, the temperature to which said bodies and particles are reheated being sufficient to cause rapid ignition of said carbon in said spent pyrolyzed carbonaceous particles in said entrained dilute phase combustion zone.

8. A method according to claim 5 wherein there is formed in the entrained dilute phase combustion zone solid material consisting essentially of reheated heat-carrying bodies, ash having a particle size of less than about 200 Tyler mesh, and attrition resistant inorganic combusted particles having a particle size greater than about 200 mesh, all of said solid material being entrained in the combustion flue gas, including the following steps: conveying said combustion flue gas containing said entrained solid material to an ash separation zone wherein said hot heat-carrying bodies and said attrition resistant inorganic combusted particles having a particle size of greater than about 200 Tyler mesh are separated from said combustion flue gas and said ash and introducing said hot heat-carrying bodies and said attrition resistant inorganic combusted particles having a particle size greater than about 200 Tyler mesh at the bottom portion of said first pyrolysis stage wherein said hot heat-carrying bodies and said attrition resistant inorganic combusted particles having a particle size greater than about 200 mesh heat the solid carbonaceous particles to their pyrolysis temperature in said pyrolysis zone.

9. A method according to claim 8 wherein the amount of oxygen in the entrained dilute phase combustion zone is sub-stoichiometric based on the amount of carbon present in said entrained dilute phase combustion zone whereby the combustion flue gas contains carbon monoxide and less than about 100 parts per million of $NO_X$.

10. A method according to claim 9 wherein the oxygen in the entrained dilute phase combustion zone is supplied by introducing hot air into said entrained dilute phase combustion zone, said air having been heated in a heat exchanger, the heat being supplied to the heat exchanger by combusting the carbon monoxide contained in said combustion flue gas after separation of said heat-carrying bodies and attrition resistant inorganic combusted particles.

11. A method according to claim 5 wherein the pyrolysis vapors produced in said pyrolysis zone are composed of carbonaceous pyrolysis liquids and carbonaceous pyrolysis gases, said carbonaceous pyrolysis liquid consisting essentially of heavy oil resid and lighter oil, including the additional steps: transporting said carbonaceous pyrolysis vapors to a fractionating zone where the heavy oil resid is condensed in and separated from the remaining carbonaceous pyrolysis vapors and, after such separation, the remaining carbonaceous pyrolysis liquids are condensed and separated from the carbonaceous pyrolysis gases, a portion of said pyrolysis gases being reintroduced into the first pyrolysis stage as the fluidizing non-combusting gas.

12. A method according to claim 11 wherein said heavy oil resid is conveyed from said fractionating zone to the second pyrolysis stage for further pyrolyzation.

13. A method according to claim 5 wherein said heat-carrying bodies and said spent carbonaceous particles, in the pyrolysis zone, have adsorbed pyrolysis products and said heat-carrying bodies and spent carbonaceous particles are steam-stripped to remove said adsorbed pyrolysis products prior to reheating said heat-carrying bodies and prior to combusting the fixed carbon on said spent carbonaceous particles in said entrained dilute phase combustion zone.

14. A method according to claim 5 wherein said solid carbonaceous particles are oil shale.

* * * * *